United States Patent [19]

Anderson

[11] 4,018,291

[45] Apr. 19, 1977

[54] PNEUMATIC HAMMER

[75] Inventor: Jack Anderson, Twinsburg, Ohio

[73] Assignee: Allied Steel & Tractor Products, Incorporated, Cleveland, Ohio

[22] Filed: Dec. 23, 1974

[21] Appl. No.: 535,580

[52] U.S. Cl. ..... 173/135; 173/139; 173/DIG. 2; 181/36 A; 181/64 A

[51] Int. Cl.[2] ..... B25D 17/12

[58] Field of Search ..... 181/36 A, 64 A, 64 R; 173/DIG. 2, 135, 139, 162, 15, 16, 17

[56] References Cited

UNITED STATES PATENTS

| | | | |
|---|---|---|---|
| 3,224,527 | 12/1965 | Waldron | 181/36 A |
| 3,332,504 | 7/1967 | Lowery | 173/DIG. 2 |
| 3,459,275 | 8/1969 | Prillwitz et al. | 181/36 A |
| 3,625,295 | 12/1971 | Gunning | 173/DIG. 2 |
| 3,739,862 | 6/1973 | Gunning | 173/16 |
| 3,757,875 | 9/1973 | Gunning | 173/DIG. 2 |
| 3,847,232 | 11/1974 | Klushin et al. | 173/DIG. 2 |

*Primary Examiner*—Ernest R. Purser
*Assistant Examiner*—William F. Pate, III
*Attorney, Agent, or Firm*—Lyon & Lyon

[57] ABSTRACT

An air hammer having a main body including an elongated cavity with a ram slidably mounted therein. The ram is driven by compressed air delivered through inlet means to the cavity in such a way as to drive the ram up and down to impact a tool. Exhaust from the hammer is directed into a plurality of elongated expansion chambers which are positioned within the body of the hammer. The expansion chambers extend to each end of the hammer body and exhaust to the atmosphere through open ports. Inserts are placed within the elongated expansion chambers to divide the chambers into properly sized cavities for greatest sound attenuation. Holes extend through these inserts for the eventual passage of exhausting air therethrough. The inserts are of neoprene having a durometer hardness of from 75 to 90. The size of the expansion chambers and the configuration and positioning of the inserts are intended to provide a muffling of the noise and shock of the exhaust. A shut off system is also provided to stop the hammer when it is unloaded.

4 Claims, 11 Drawing Figures

FIG. 1.
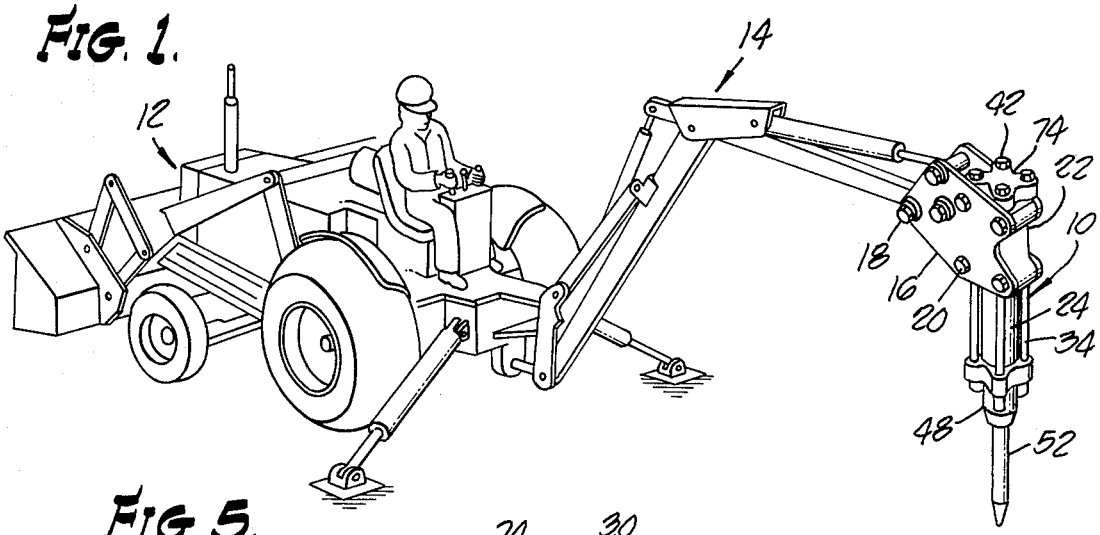
FIG. 5.
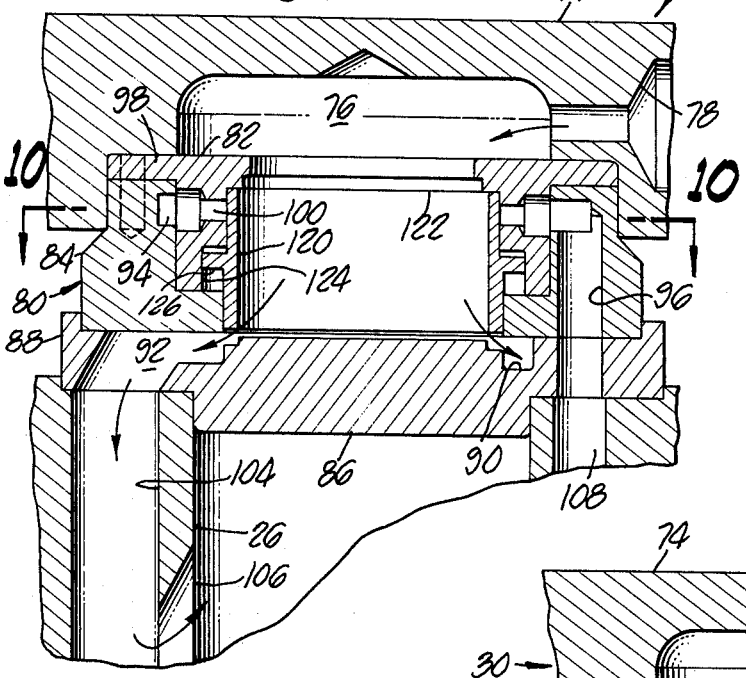
FIG. 5A.
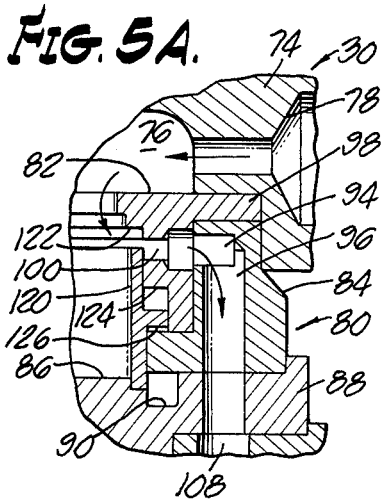
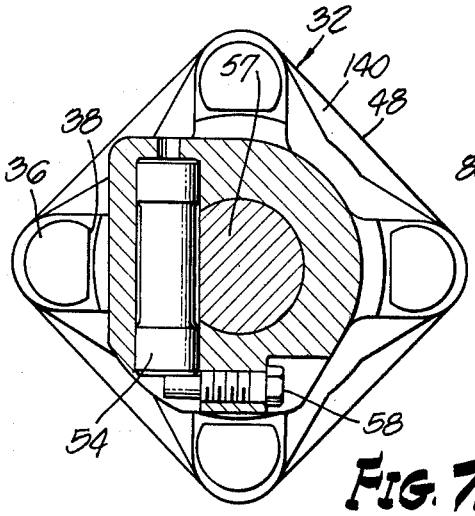
FIG. 7.
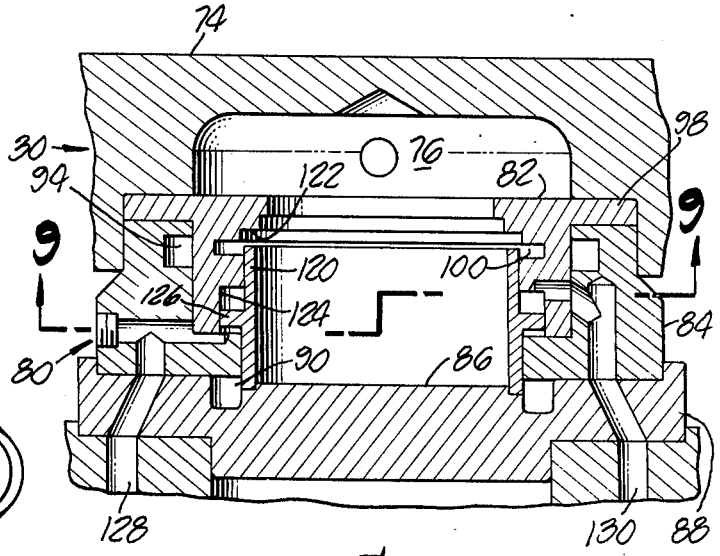
FIG. 6.

PNEUMATIC HAMMER

BACKGROUND OF THE INVENTION

The field of the present invention is pneumatic hammers. More specifically, the present invention is directed to an improved pneumatic hammer having an integral sound attenuation system.

Pneumatic tools and particularly hammers of any substantial size have always had the problem of being too noisy. This noise partially results from the rapid release of compressed air once it has driven the piston on a power stroke. This problem of noise has been emphasized by recent local and national interest in noise abatement. Many attempts have been made to reduce the noise associated with the release of compressed air from pneumatic hammers. Some devices for the reduction of noise eminating from such pneumatic hammers have been developed. One solution has been to add a conventional muffler to the exhaust ports of a conventional pneumatic hammer. However, these mufflers add weight, add substantially to the size of the unit and require sturdy means for fastening to prevent untimely detachment of the mufflers due to the harsh vibratory and shock loads developed by operation and use of the hammer. Another approach has been to completely encase the hammer and its outlets in a shell. However, such devices require complicated muffler structures making them more expensive and more prone to failure. Further, such devices add substantially to the weight and size of the unit and are subject to the extreme vibrational and shock loads developed by the hammer. Thus, add-on mufflers and the like, developed as an attempt to reduce the exhaust noise of such pneumatic hammers, have met with only limited success. Problems of cost of manufacture, size, weight and increased tendency toward failure have resulted.

SUMMARY OF THE INVENTION

The present invention is directed to a pneumatic hammer having a plurality of expansion chambers located within the body of the hammer for the attenuation of noise and shock in the air exhaust. Inserts are provided within the expansion chambers to properly size the cavities within the chambers to most effectively muffle the noise and shock of the exhaust from the pneumatic hammer. The expansion chambers are elongated cavities disposed adjacent the main cavity enclosing the ram. These expansion chambers extend to exhaust at both ends of the hammer body through holes in the inserts. Deflection means are provided in front of the exhaust openings of the expansion chambers to diffuse and deflect the exhausting air. A novel shut off system is also provided.

The placement of the expansion chambers directly within the body eliminates the major disadvantages of conventional muffling systems. Specifically, a one piece casting is employed for the hammer body and muffling system. Consequently, manufacturing complication and expense is avoided. Further, the placement of the expansion chambers within the body casting circumvents the problems associated with the mounting of external muffling systems on a body subjected to extreme vibration and shock. The placement of the chambers also keeps the size and weight of the total pneumatic hammer assembly at a minimum.

Accordingly, it is an object of the present invention to provide an improved pneumatic hammer.

It is a further object of the present invention to provide an integral muffling system for a pneumatic hammer.

Another object of the present invention is to provide a pneumatic hammer having expansion chambers integral with the body of the hammer for receiving and muffling the noise and shock of the air exhaust.

Further objects and advantages will appear hereinafter.

BRIEF DESCRIPTION OF THE DRAWINGS

FIG. 1 is a prospective view of the present invention as it can be employed with a heavy duty vehicle.

FIG. 5 is a detailed cross sectional view as seen in FIG. 3, with the valve piston in the up position.

FIG. 5*a* is a detailed cross sectional view of a pneumatic hammer of the present invention as seen in FIG. 5, with the valve piston in the down position.

FIG. 6 is a detailed cross sectional view of the inlet control means as seen in FIG. 2.

FIG. 7 is a cross sectional bottom view of a pneumatic hammer of the present invention as taken along line 7—7 of FIG. 2.

DETAILED DESCRIPTION OF THE DRAWINGS

Figure 2:
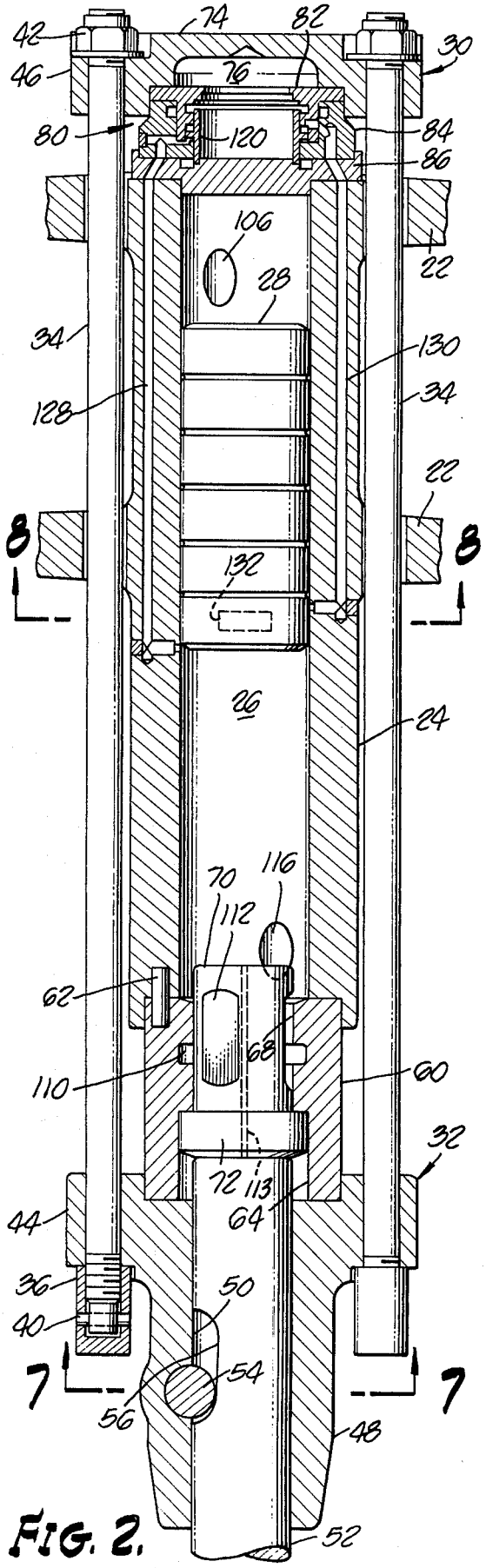
FIG. 2 is a cross sectional elevation of a pneumatic hammer of the present invention where the section is taken through the valve actuating passageways.

Turning in detail to the drawings, a pneumatic hammer is disclosed. The hammer, generally designated 10, is shown attached to a heavy duty vehicle 12 in FIG. 1. The hammer 10 is conveniently attached to the heavy duty vehicle 12 by means of an articulated arm assembly 14, normally employed as part of a back-hoe assembly. The hammer 10 is attached to the articulated arm assembly 14 by means of two parallel mounting brackets 16. The mounting bracket 16 employs conventional fastening techniques for attachment to the articulated arm assembly 14. Pins 18 extend from one bracket to the other and engage the articulated arm assembly 14 between brackets. The mounting brackets 16 are mounted to the pneumatic hammer 10 and held in a mutually parallel relationship by fasteners 20 against bosses 22 extending from the main body of the hammer 10. Thus, the air hammer may be securely held to a heavy duty vehicle and yet an operator may exert articulated control over the hammer 10. Naturally, the size of the hammer 10 may be scaled up or down to accommodate different ranges of jobs. It is intended that the present disclosure is equally applicable to a larger or smaller pneumatic hammer.

Figure 8:
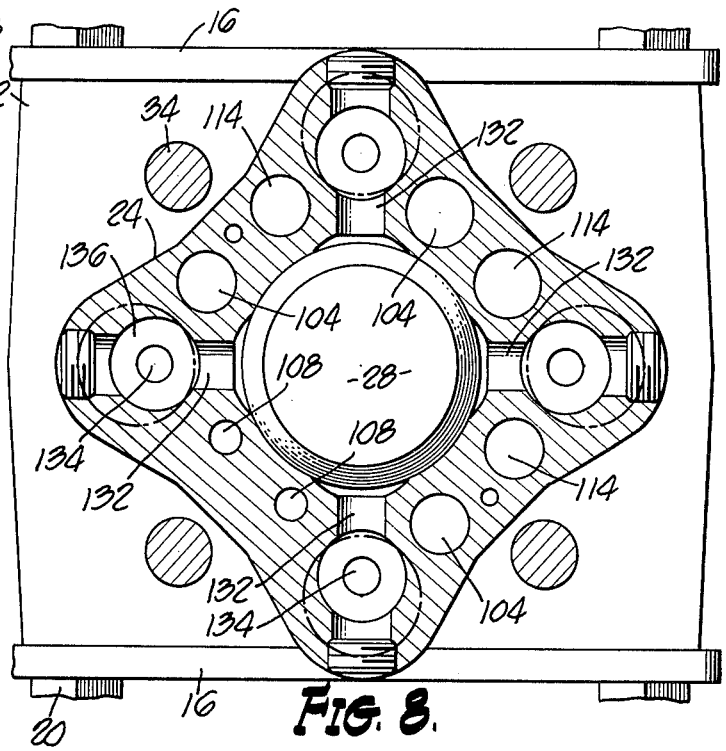
FIG. 8 is a cross sectional bottom view of a pneumatic hammer of the present invention taken along line 8—8 of FIG. 2.

Looking to the hammer 10 in greater detail, a main body 24 is employed. The main body 24 is very roughly rectangular in cross section throughout the majority of its length as can be seen in FIG. 8. The bosses 22 then extend outwardly at the upper end of the body for receipt of the fasteners 20. A central elongated cavity 26 is most conveniently cylindrical and is designed to receive and slidably retain a ram 28. The ram 28 is designed to fit closely within the central elongated cavity 26 to prevent the passage of substantial amounts of air between the ram 28 and the wall of the central elongated cavity 26. At the upper end of the main body 24, a head assembly generally designated 30 provides an operative closure for the central elongated cavity 26. At the lower end of the main body 24, an anvil and tool holder assembly, generally designated 32, forms a closure for the lower end of the central elongated cavity 26.

The head assembly 30, the main body 24 and the anvil and tool holder assembly 32 are tied together by means of four tie rods 34 as best seen in FIG. 2. At the lower end, the tie rods extend through the anvil and tool holder assembly 32 where they are threaded into cap nuts 36. The cap nuts 36 are generally cylindrical with a flat side 38 as seen in FIG. 7. The flat sides 38 of the various cap nuts 36 cooperate with a corresponding surface on the anvil and tool holding assembly 32 to prevent rotation of the cap nuts 36 relative to the hammer 10. The tie rods 34 are threaded into the cap nuts 36 and are pinned by means of drive pins 40. Thus, the tie rods 34 are unable to rotate relative to the cap nuts 36 and in turn to the hammer 10. At the head assembly 30, locking nuts 42 are threaded onto the tie rods 34 and tightened to place the tie rods 34 in tension.

Looking to the anvil and tool holding assembly 32, a tool holder 48 is at the lowermost position of the pneumatic hammer 10. The tool holder 48 includes the lugs 44 for retaining the lowermost ends of the tie rods 34. The tool holder 48 includes a bore 50 to receive a tool 52. To hold the tool 52 in position, a conventional retainer pin 54 extends through the tool holder 48 to cooperate with notch 56 provided in the tool 52. The tool retainer pin 54 is held by a retaining screw 58 as can be seen in FIG. 7. At the other end of the cavity in which the tool retainer pin is positioned, the tool holder 48 is closed. Thus, the tool holder 48 and the retaining screw 58 cooperate to hold the tool retainer pin 54 in position.

Located between the main body 24 and the tool holder 48 is an anvil bushing 60. The anvil bushing 60 is positioned within a first recess at the lower end of the main body 24 and a second recess located in the upper side of the tool holder 48. The tensioned tie rods 34 then hold the anvil bushing 60 in compression between the main body 24 and the tool holder 48. A pin 62, as seen in FIG. 2, prevents the anvil bushing 60 from rotating relative to either the main body 24 or the tool holder 48.

An anvil 70 is positioned within the anvil bushing 60. The anvil bushing 60 includes a major bore 64 and a minor bore 68 to accommodate the anvil which is conveniently cylindrical and has a collar 72 located at one end. The collar 72 is sized to fit within the major bore 64 of the anvil bushing 60 and the main body of the anvil 70 fits within the minor bore 68 of the anvil bushing 60.

When positioned on some work, the tool 52 extends upwardly to contact the anvil 70. Further, the ram 28 may move in the central elongated cavity 26 to a lower position for impacting the upper end of the anvil 70. Thus, impact forces may be applied by the ram 28, through the anvil 70 to the tool 52. It may be noted that the tool 52 will drop from engagement with the anvil 70 when the tool is not in contact with the ground or some other work. This prevents the hammer from destroying the tool retainer pin 54 if it continues to operate without load. The various air passageways located in the anvil and tool holder assembly 32 will be discussed below.

Turning to the head assembly 30, a cap 74 forms the uppermost member of the hammer 10. The cap 74 includes the lugs 46 employed to retain the tie rods 34. A central chamber 76 is provided in and below the cap 74 for receiving compressed air from an inlet 78. The incoming compressed air delivered to the central chamber 76 is then controlled by an inlet control means 80 forming part of the head assembly 30. The inlet control means is positioned between the main body 24 and the cap 74. This inlet control means 80 is held in compression between the main body 24 and the cap 74 by means of the tie rods 34. The inlet control means 80 along with a variety of passageways extending through the hammer provide an inlet means for directing air to the elongated cavity 26 for control of the ram 28.

The inlet control means 80 include an upper valve body 82, a central valve body 84 and a lower valve body 86. The lower valve body 86 provides a head for the central elongated cavity 26 and extends outwardly by means of an annular flange 88 to rest above the main body 24. A circular channel 90 extends about the upper surface of the lower valve body 86. This circular channel 90 receives compressed air delivered through inlets 78 and channels that air to three intake ports 92. One intake port 92 is shown in FIG. 5. The location of all three intake ports is illustrated in phantom in FIG. 9.

Figure 9:
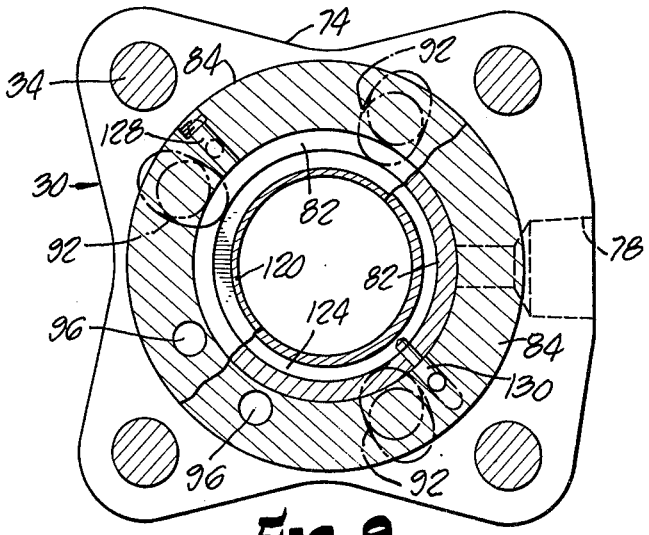
FIG. 9 is a cross sectional bottom view as taken along line 9—9 of FIG. 6.
Figure 10:
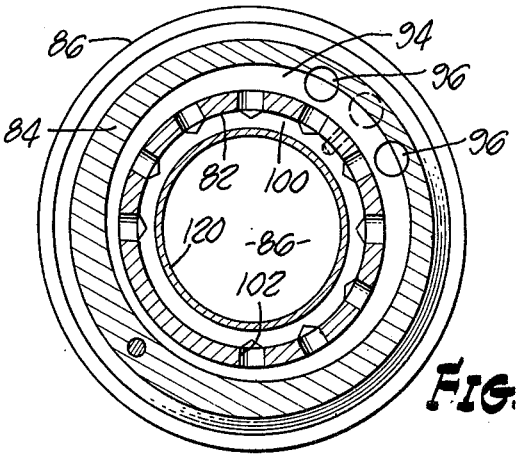
FIG. 10 is a cross sectional plan view of the pneumatic hammer of the present invention taken along line 10—10 of FIG. 5.

The central valve body 84 rests above the lower valve body 86 and has a bore located therethrough to accommodate the upper valve body 82. The central valve body also includes a circular channel 94 which acts as a manifold to receive compressed air and direct that air to intake ports 96. Two such intake ports 96 are provided as can be seen in FIGS. 9 and 10. The upper valve body 82 extends into the bore of the central valve body 84. An annular flange 98 extends outwardly from the upper valve body 82 between the central valve body 84 and the cap 74 as a means for holding the upper valve body 82 in position. The upper valve body 82 also includes a circular channel 100 cut into the bore of the upper valve body 82. A plurality of holes 102 extend through the wall of the upper valve body 82 between the circular channel 100 and the outer periphery of the upper valve body 82. The circular channel 94 in the central valve body 84, the circular channel 100 in the upper valve body 82 and the holes 102 provide a continuous passageway means for directing compressed air from the inlet 78 to the intake ports 96.

Thus, two separate intake passageway systems are provided within the intake control means 80. The first system incorporated the circular channel 90 to direct incoming compressed air from the inlet 78 to the intake ports 92. The second system directs compressed air from the inlet 78 through the circular channel 100, holes 102 and circular channel 94 to the intake ports 96. Looking to FIG. 3, the intake ports 92 communicate with a main intake passageway 104. There are three such main intake passageways 104 as can be seen in FIG. 8. The main intake passageways 104 extend substantially the length of the main body 24. This provides a reservoir area for compressed air. Main ports 106 are located near the upper end of the elongated cavity 26. Thus, compressed air may enter the elongated cavity 26 above the ram 28 when the ram is in an upper position as shown in FIG. 2. Naturally, the incoming compressed air will force the ram 28 downwardly to strike the anvil 70 during operation of the unit.

Figure 4:
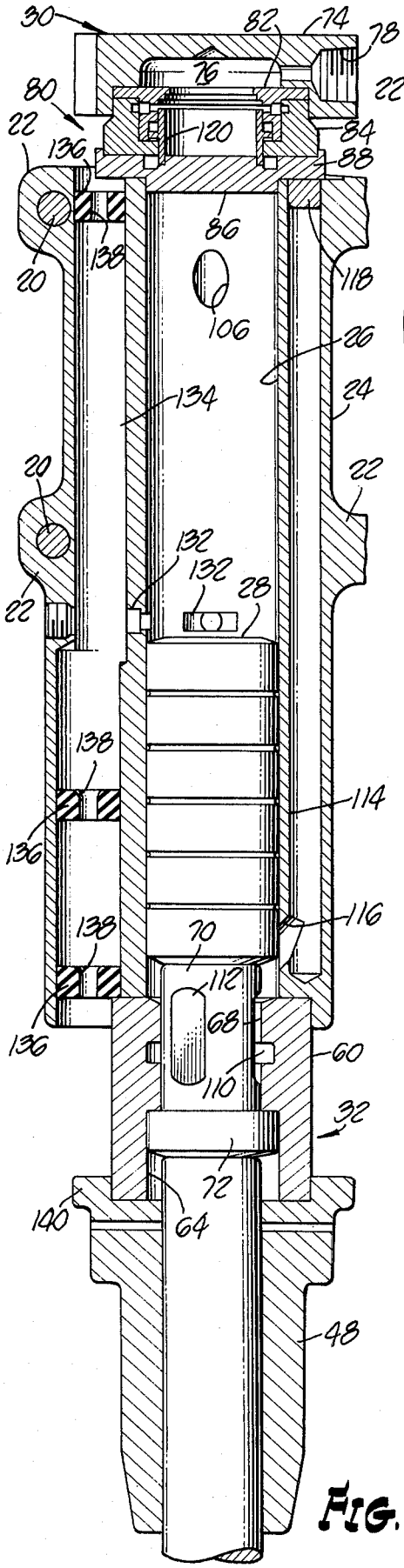
FIG. 4 is a cross sectional elevation of a pneumatic hammer of the present invention with the section taken along an exhaust expansion chamber and a lower chamber reservoir.

The intake ports 96 fed from the second inlet system provide air to the ram return intake passageways 108 extend the complete length of the main body 24 and are directed to a circular channel 110 surrounding the anvil 70. When the tool 52 has been forced against some work, the tool 52 forces the anvil 70 to an uppermost position in the anvil bushings 60. When the anvil 70 is in the uppermost position as illustrated in FIGS. 2 & 4, the ram return intake passageways 108 can communicate with the central elongated cavity 26 beneath the ram 28 through the circular channel 110 and notches 112 positioned at three locations about the body of the anvil 70 adjacent the circular channel 110. This forces the ram 29 upwardly in position for developing another blow against the anvil 70.

A shut off means is provided to turn the hammer off when the tool is not engaging work. When the tool 52 is not forced against any work, the tool 52 and anvil 70 may drop to a lowermost position out of the way of the ram 28. Also, when the hammer is inverted, the last blow of the ram 28 will force the anvil 70 down into the anvil bushing 60 with the tool in an unloaded condition. In either instance, when air is applied to the ram intake passageways 108 with the anvil 70 in the lowermost position, compressed air passes through the circular channel 110 and the notches 112 into the major bore 64 of the anvil bushing 60. The pressure thus provided forces against the collar 72 to retain the anvil 70 in the lowermost position regardless of the relative position of the hammer. Thus, the anvil 70 will remain displaced from the ram 28 until substantial force is applied in the opposite direction to the tool 52 by engaging work. Once a tool moves the anvil 70 upward to the position as illustrated in FIGS. 2 and 4, compressed air from the ram intake passageways 108 will pass to the underside of the ram 28 thereby forcing the ram 28 into the uppermost position.

Figure 3:
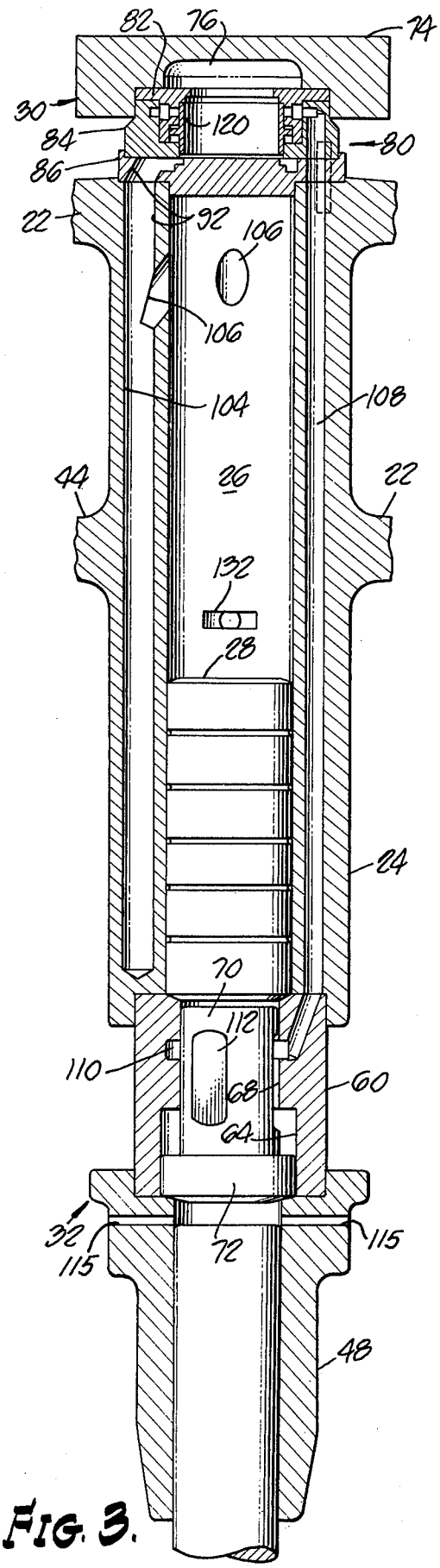
FIG. 3 is a cross sectional elevation of a pneumatic hammer of the present invention with the section taken along a main inlet passageway and a ram return inlet passageway.

When the anvil 70 is in the lower position, air cannot move from the notches 112 into the central elongated cavity 26. Consequently, the ram 28 will not be forced to the upper end of the elongated cavity 26. Instead, a passageway 113 is provided through the anvil 70. Exhaust passageways 115 extend through the tool holder 48. Thus, when the anvil 70 drops to the lower position as seen in FIG. 3, the portion of the elongated cavity 26 below the ram 28 will be depressurized as air escapes through passageways 113 and 115. This allows the ram 28 to come to rest at the lowermost position in the elongated chamber where it will remain until the anvil 70 is again raised by the tool 52. The passage of air from the lower portion of the elongated chamber 26 is prevented when the hammer is in operation because the tool 52 covers one end of the passageway 113 and extends to cover the passageways 115. Thus an automatic shut off mechanism is provided without added mechanical complication or detrimental effects to the performance of the machine.

The pressure forces moving the ram alternately in the upward and downward directions are only partially supplied by the incoming air passed through the main intake passageways 104 and ram return intake passageways 108. A spring effect is provided by the compression of air on either side of the ram 28 as the ram moves up and down in the central elongated cavity 26. To increase the efficiency of these secondary forces, extra cavities are provided for increasing the available volume on either side of the ram 28. On the upper side of the ram 28, the main intake passageways 104 extend substantially the length of the main body 24. To deliver air to the upper portion of the central elongated cavity 26, it is only necessary to extend the main intake passageways 104 to the main ports 106. However, the further extension of the main intake passageways 104 provides a reservoir for the storage of air and an effective increase in the volume of the central elongated cavity 26 above the ram 28. Similarly, reservoirs 114 are provided along the length of the main body 24 which communicate with the lower portion of the central elongated cavity 26 beneath the ram 28. Ports 116, as can best be seen in FIG. 4, extend between the reservoirs 114 and the lower portion of the elongated cavity 26. A plug 118 prevents the escape of air from the reservoir 114.

To control the alternate introduction of air through the main intake passageways 104 and the ram return intake passageways 108, the inlet control means generally designated 80 includes a valve piston 120 slidably positioned within the upper valve body 82 and the central valve body 84. The valve piston 120 is cylindrical in structure and is capable of extending to mate with the lower valve body 86 to sever communication between the central chambers 76 and the circular channel 90. Similarly, the valve piston 120 may extend to a seat 122 severing communication between the central chamber 76 and the circular channel 100. Thus, the valve piston 120 may either allow incoming compressed air through the main intake passageways 104 or through the ram return intake passageways 108.

To control the valve piston 120 an annular cavity 124 is provided by the upper valve body 82. An annular flange 126, fixed to the valve piston 120, extends across the annular cavity 124 to run against the inner bore of the upper valve body 82. The presence of the annular flange 126 and the annular cavity 124 thereby creates two circular cavities which when alternately filled with compressed air will force the valve piston 120 to move up and down and alternately cover circular channels 90 and 100. To control the position of the valve piston 120, control passageways 128 and 130 extend from the central elongated cavity 26 to either side of the annular flange 126 of the valve piston 120 as can best be seen in FIG. 2. The control passageway 128 extends to a point generally below the bottom of the ram 28 when the ram 28 is in an upper position. Thus, when the ram is in the upper position, the control passageway 128 forces the valve piston 120 into an upper position to close off the ram return intake passageways 108. At the same time, the main intake passageways 104 are open and pneumatic pressure is delivered to the upper side of the ram 28 for a downward stroke. Alternately, the control passageway 130 extends to a position just above the upper surface of the ram 28 when the ram is in the lower position within the central elongated cavity 26. Thus, pressure is delivered from the upper portion of the elongated cavity 26 to the control passageway 130 to force the valve piston 120 down. This closes off the main intake passageways 104 and opens the ram return intake passageways 108. Thus, pneumatic pressure is delivered to the lower portion of the central elongated cavity 26 to force the ram to return to the upper position. By introducing air through the inlet 78 and forcing the tool 52 against an object, the ram 28 will commence to oscillate and impact on the anvil 70 to perform useful work.

It is necessary to exhaust some air from the upper portion of the central elongated cavity 26 in order that the ram 28 may fully return to the upper position. To allow the exhausting of this air, outlet means are provided. Four outlet ports 132 are positioned about the central elongated cavity 26. These outlet ports 132 can best be seen in FIGS. 4 and 8. The outlet ports 132 each extend to an expansion chamber 134. There are four such expansion chambers 134 located about and within the main body 24. These expansion chambers 134 extend the length of the main body 24 adjacent the central elongated cavity 26. Thus, exhausting air passing through outlet ports 132 may travel in either direction through the expansion chambers 134 to exhaust into the atmosphere. Each expansion chamber 134 includes means for dividing the expansion chambers into separate cavities. These means include inserts 136 which are press fit into the expansion chambers.

The expansion chambers are each comprised of two cavities of different diameters. The smaller cavity of each expansion chamber has an inside diameter of 1 13/16 inches (4.60 cm) and the larger cavity has an inside diameter of 2¼ inches (5.72 cm). The distance from the center line of the outlet port 132 to the insert 136 placed in the smaller diameter is 13 9/16 inches (35.70 cm). The distance from the center line of the outlet port 132 to the insert 136 located in the middle of the larger cavity is 5 13/16 inches (14.76 cm). The distance between the first insert 136 in the larger diameter cavity and the second insert 136 at the end of the larger diameter cavity is 5½ inches (13.97 cm). The inserts 136 are 1 inch (2.54 cm) in thickness and have a hole 138 centrally located therethrough having a diameter when positioned of ⅝ of an inch (1.59 cm). The inserts are conveniently made of neoprene and have a durometer hardness of around 75 to 90. These dimensions are for a hammer delivering 400 blows/min. and exhausting 250 cu.ft./min.(7075 l/min.).

Thus, the exhausting air from the pneumatic hammer passes through outlet ports 132 into the four expansion chambers 134. In these expansion chambers, the noise and shock of the exhaust is substantially reduced before the air is allowed to escape through the holes 138 located in the inserts 136. This arrangement avoids the use of attached mufflers and the like. The exhausting air from the expansion chambers 134 is dispersed and deflected by portions of the pneumatic hammer. From above, the annular flange 88 extends in front of the outlet to the expansion chambers 134 to force exhaust from a vertical path. Similarly, the tool holder 48 includes a flange 140 to disburse and redirect the exhaust directed downwardly from the expansion chamber 134. This prevents the exhaust from stirring up dirt and the like.

Thus, a pneumatic hammer is disclosed which incorporates an integral muffling system. While embodiments and applications of this invention have been shown and described, it would be apparent to those skilled in the art that many more modifications are possible without departing from the inventive concepts herein described. The invention, therefore, is not to be restricted except by the spirit of the appended claims.

What is claimed is:

1. An air hammer comprising
a body, said body including an elongated cavity;
a ram slidably positioned within said elongated cavity;
inlet means for directing air to said elongated cavity for controlling the position and motion of said ram; and
outlet means for releasing air from said elongated cavity, said outlet means including at least one expansion chamber located in said body adjacent said elongated cavity, said expansion chamber being in communication with said elongated cavity and extending to exhaust from said body into the atmosphere, said expansion chamber being elongated and including ports at each end of said body where said expansion chamber exhausts into the atmosphere.

2. The hammer of claim 1 further including deflection means extending in front of said ports to deflect and diffuse exhaust passing from said ports.

3. An air hammer comprising:
a body, said body including an elongated cavity;
a ram slidably positioned within said elongated cavity;
inlet means for directing air to said elongated cavity for controlling the position and motion of said ram;
outlet means for releasing air from said elongated cavity;
an anvil slidably positioned in said body below said ram;
a tool slidably positioned in said body below said anvil; and
shut off means for turning off said ram when said tool is not engaging work, said shut off means including first passageway means to direct air from said inlet means to hold said anvil away from said ram, second passageway means extending through said anvil in communication with said elongated cavity beneath said ram at first end and with said tool at another end, an exhaust passageway means allowing air to escape from between said anvil and said tool when said tool is not engaging work.

4. An air hammer comprising
a body, said body including a primary elongated cavity and at least one secondary cavity;
a ram slidably positioned within said primary elongated cavity;
inlet means for directing air to said primary elongated cavity for controlling the position and motion of said ram; and
outlet means for releasing air from said primary elongated cavity, said outlet means including at least one expansion chamber located in at least said secondary cavity in said body adjacent said primary elongated cavity, said expansion chamber being in communication with said primary elongated cavity and extending to exhaust from said body into the atmosphere, said expansion chamber including means for dividing said expansion chamber, said dividing means including holes therethrough for the passage of exhausted air from said divided expansion chamber, said dividing means including inserts sized to be press fit into said expansion chamber, said inserts being of neoprene.

* * * * *